US008430648B2

(12) United States Patent
Kanayama et al.

(10) Patent No.: US 8,430,648 B2
(45) Date of Patent: Apr. 30, 2013

(54) ROTARY COMPRESSOR

(75) Inventors: Takehiro Kanayama, Kusatsu (JP); Kouki Morimoto, Kusatsu (JP); Masanori Yanagisawa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 511 days.

(21) Appl. No.: 12/159,158

(22) PCT Filed: Dec. 11, 2006

(86) PCT No.: PCT/JP2006/324664
§ 371 (c)(1),
(2), (4) Date: Jun. 25, 2008

(87) PCT Pub. No.: WO2007/074631
PCT Pub. Date: Jul. 5, 2007

(65) Prior Publication Data

US 2010/0226796 A1 Sep. 9, 2010

(30) Foreign Application Priority Data

Dec. 27, 2005 (JP) ..... 2005-374059

(51) Int. Cl.
*F04B 53/00* (2006.01)

(52) U.S. Cl.
USPC ..... 417/312; 417/410.3

(58) Field of Classification Search ..... 417/312, 417/410.3, 540, 541, 542, 543, 902; 181/229, 181/249, 269, 272, 282, 283, 403; 165/51, 165/52, 135, 136, 145, 159
See application file for complete search history.

(56) References Cited

U.S. PATENT DOCUMENTS

| | | | | |
|---|---|---|---|---|
| 2,200,222 | A * | 5/1940 | Tarleton | 417/312 |
| 2,764,342 | A * | 9/1956 | Dills | 418/88 |
| 4,573,879 | A * | 3/1986 | Uetuji et al. | 417/312 |
| 4,990,073 | A * | 2/1991 | Kudo et al. | 418/60 |
| 5,203,679 | A * | 4/1993 | Yun et al. | 417/312 |
| 6,106,242 | A * | 8/2000 | Sung | 417/312 |
| 6,176,687 | B1 * | 1/2001 | Kim et al. | 417/312 |
| 6,398,520 | B2 * | 6/2002 | Han | 417/312 |
| 6,447,274 | B1 * | 9/2002 | Horihata et al. | 418/60 |
| 6,568,924 | B2 * | 5/2003 | Kawamura et al. | 417/540 |

(Continued)

FOREIGN PATENT DOCUMENTS

| | | | |
|---|---|---|---|
| JP | 04-005485 | A | 1/1992 |
| JP | 09-151888 | A | 6/1997 |
| JP | 2003-097472 | A | 4/2003 |

OTHER PUBLICATIONS

"space." Dictionary.com Unabridged. Random House, Inc. Jun. 23, 2011. <Dictionary.com http://dictionary.reference.com/browse/space>.*

*Primary Examiner* — Peter J Bertheaud
*Assistant Examiner* — Dnyanesh Kasture
(74) *Attorney, Agent, or Firm* — Global IP Counselors

(57) ABSTRACT

A stagnation space defined by barriers is provided in a first muffler chamber communicating with a first cylinder chamber. The stagnation space overlaps with a refrigerant-gas inlet side of the first cylinder chamber, the inlet side being bordered by a center plane as viewed in a direction of a center axis of the first cylinder chamber. In the first muffler chamber, the high-temperature, high-pressure refrigerant gas is unlikely to enter into the stagnation space, so that heat is less absorbed to the inlet side of the first cylinder chamber.

8 Claims, 3 Drawing Sheets

U.S. PATENT DOCUMENTS

| | | | | |
|---|---|---|---|---|
| 2003/0068236 | A1 | 4/2003 | Tadano et al. | |
| 2003/0108438 | A1* | 6/2003 | Kim et al. | 417/312 |
| 2004/0151603 | A1 | 8/2004 | Tadano et al. | |
| 2004/0154329 | A1 | 8/2004 | Tadano et al. | |
| 2004/0165998 | A1 | 8/2004 | Tadano et al. | |
| 2004/0165999 | A1 | 8/2004 | Tadano et al. | |
| 2004/0241012 | A1* | 12/2004 | Kim et al. | 417/312 |
| 2006/0093498 | A1* | 5/2006 | Kim | 417/417 |
| 2006/0120894 | A1* | 6/2006 | Shimizu et al. | 417/410.3 |
| 2006/0168994 | A1 | 8/2006 | Tadano et al. | |

* cited by examiner

ROTARY COMPRESSOR

TECHNICAL FIELD

The present invention relates to a rotary compressor to be used for, for example, air conditioners, refrigerators or the like.

BACKGROUND ART

Conventionally, there has been provided a rotary compressor which includes a cylinder, an end plate member attached to an opening end of the cylinder, a muffler cover attached to one side of the end plate member opposite to another side to which the cylinder is attached, and a roller for partitioning a cylinder chamber defined by the cylinder and the end plate member into a refrigerant-gas inlet chamber and a refrigerant-gas discharge chamber (see JP H9-151888 A).

DISCLOSURE OF THE INVENTION

However, in the above conventional rotary compressor, a high-temperature refrigerant gas discharged from the cylinder chamber, when passing through a muffler chamber defined by the muffler cover and the end plate member, passes through a space overlapping with the low-temperature, low-pressure inlet chamber of the cylinder chamber. That is, of the high-temperature refrigerant gas, heat is absorbed to the inlet chamber of the cylinder chamber. It has been the case, therefore, that from the refrigerant gas discharged from the cylinder chamber, heat transfer to the cylinder chamber is accelerated, resulting in degradation of the compression efficiency.

Accordingly, an object of the present invention is to provide a rotary compressor which suppresses the heat transfer to the cylinder chamber from the refrigerant gas discharged from the cylinder chamber into the muffler chamber, thus capable of improving the compression efficiency.

To accomplish the above object, a rotary compressor of the present invention comprises:

a cylinder;

an end plate member attached to an opening end of the cylinder;

a muffler cover attached to one side of the end plate member opposite to another side to which the cylinder is attached; and a roller and a blade for partitioning a cylinder chamber, which is defined by the cylinder and the end plate member, into a refrigerant-gas inlet chamber and a refrigerant-gas discharge chamber, wherein the blade is supported by the cylinder, and the roller revolves around a center axis of the cylinder chamber, a stagnation space defined by barriers is provided in a muffler chamber which is defined by the muffler cover and the end plate member and which communicates with the cylinder chamber, and the stagnation space overlaps with a refrigerant-gas inlet side of the cylinder chamber, the inlet side being bordered by a center plane which passes through a center of the blade most projecting into the cylinder chamber and through a center axis of the cylinder chamber, as viewed in a direction of the center axis of the cylinder chamber.

In the rotary compressor of this invention, since the muffler chamber is provided with the stagnation space defined by the barriers, the high-temperature, high-pressure refrigerant gas discharged from the cylinder chamber to the muffler chamber is obstructed by the barriers, thus being unlikely to enter into the stagnation space. Also, since the stagnation space of the muffler chamber overlaps with the refrigerant-gas inlet side of the cylinder chamber, the inlet side being bordered by the center plane as viewed in the direction of the center axis of the cylinder chamber, the high-temperature, high-pressure refrigerant gas is unlikely to pass through the space overlapping with the low-temperature, low-pressure inlet side of the cylinder chamber, so that heat is less absorbed to the inlet side of the cylinder chamber.

Thus, heat transfer to the cylinder chamber from the refrigerant gas discharged from the cylinder chamber to the muffler chamber is suppressed, so that the compression efficiency can be improved.

In the rotary compressor of one embodiment, the barriers are formed integrally with the end plate member, and the muffler cover is formed into a flat plate shape.

In the rotary compressor of this embodiment, since the barriers are formed integrally with the end plate member and the muffler cover is formed into a flat plate shape, the muffler cover can be formed simply.

The rotary compressor of one embodiment, further comprises another muffler cover attached to one side of the muffler cover opposite to another side to which the end plate member is attached, wherein the another muffler cover and the muffler cover define another muffler chamber communicated with the muffler chamber.

In the rotary compressor of this embodiment, since another muffler chamber to be communicated with the muffler chamber is formed, a muffler space can be ensured by this another muffler chamber.

In the rotary compressor of one embodiment, the end plate member has a body portion, and a boss portion provided on one surface of the body portion, and the barriers are formed integrally with the end plate member so as to couple the body portion and the boss portion to each other.

In the rotary compressor of this embodiment, since the barriers are formed integrally with the end plate member so as to couple the body portion and the boss portion to each other, the barriers function as ribs, so that the strength of the end plate member can be improved.

According to the rotary compressor of the present invention, the stagnation space of the muffler chamber overlaps with the refrigerant-gas inlet side of the cylinder chamber, the inlet side being bordered by the center plane as viewed in the direction of the center axis of the cylinder chamber, heat transfer to the cylinder chamber from the refrigerant gas that has been discharged from the cylinder chamber to the muffler chamber is suppressed, so that the compression efficiency can be improved.

DETAILED DESCRIPTION OF THE INVENTION

Hereinbelow, the present invention will be described in detail by way of embodiments thereof illustrated in the accompanying drawings.

Figure 1:
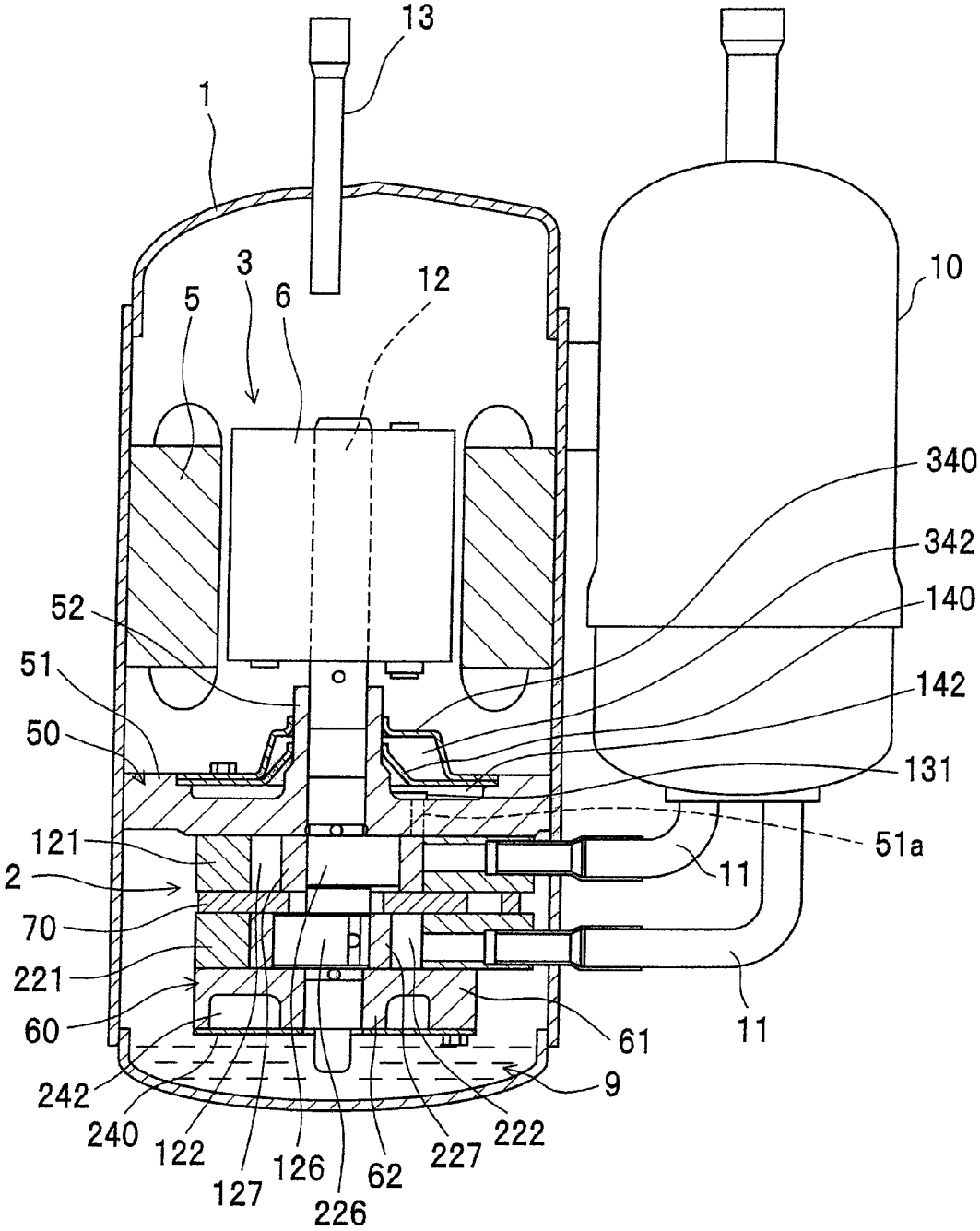
FIG. 1 is a longitudinal sectional view showing an embodiment of the rotary compressor of the present invention.

FIG. 1 is a longitudinal sectional view showing an embodiment of the rotary compressor of the invention. This rotary compressor includes a closed container 1, a compression element 2 placed within the closed container 1, and a motor 3 which is placed within the closed container 1 and which drives the compression element 2 via a shaft 12. The rotary compressor, which is the so-called high-pressure dome type, has the compression element 2 placed lower and the motor 3 placed upper within the closed container 1.

The motor 3 has a rotor 6, and a stator 5 placed radially outside the rotor 6 with an air gap placed therebetween. The shaft 12 is fitted to the rotor 6.

The rotor 6 has a rotor body formed of, for example, a laminated electromagnetic steel sheet, and a magnet buried in the rotor body. The stator 5 has a stator body formed of, for example, iron, and a coil wound around the stator body.

As to the motor 3, an electric current is passed through the coil to generate electromagnetic force in the stator 5, causing the rotor 6 to be rotated together with the shaft 12 so that the compression element 2 is driven via the shaft 12.

An inlet pipe 11 for suction of the refrigerant gas is fitted to the closed container 1, and an accumulator 10 is coupled to the inlet pipe 11. That is, the compression element 2 sucks in the refrigerant gas from the accumulator 10 through the inlet pipe 11.

The refrigerant gas can be obtained by controlling a condenser, an expansion mechanism and an evaporator (not shown) which constitute an air conditioner as an example of a refrigeration system in combination with the rotary compressor.

The rotary compressor discharges a compressed high-temperature, high-pressure discharge gas from the compression element 2 to make the closed container 1 internally filled with the gas, while passing the discharge gas through a gap between the stator 5 and the rotor 6 of the motor 3 to make the motor 3 cooled therewith, and then discharging the gas outside from the discharge pipe 13. Lubricating oil 9 is reserved under a high-pressure region within the closed container 1.

The compression element 2 has, as seen in an order from top to bottom along a rotational axis of the shaft 12, an upper-side end plate member 50, a first cylinder 121, an intermediate end plate member 70, a second cylinder 221 and a lower-side end plate member 60.

The upper-side end plate member 50 and the intermediate end plate member 70 are attached to upper and lower opening ends of the first cylinder 121, respectively. The intermediate end plate member 70 and the lower-side end plate member 60 are attached to upper and lower opening ends of the second cylinder 221, respectively.

The first cylinder 121, the upper-side end plate member 50 and the intermediate end plate member 70 constitute a first cylinder chamber 122. The second cylinder 221, the lower-side end plate member 60 and the intermediate end plate member 70 constitute a second cylinder chamber 222.

The upper-side end plate member 50 has a disc-shaped body portion 51, and a boss portion 52 provided in a center of the body portion 51 so as to extend upward. The body portion 51 and the boss portion 52 are passed through by the shaft 12. The body portion 51 is provided with a discharge opening 51*a* communicating with the first cylinder chamber 122.

A discharge valve 131 is attached to the body portion 51 so as to be positioned on one side of the body portion 51 opposite to the side to which the first cylinder 121 is attached. The discharge valve 131 is, for example, a reed valve which opens and closes the discharge opening 51*a*.

On the body portion 51, to its one side opposite to the side to which the first cylinder 121 is attached, a cup-shaped first muffler cover 140 is provided so as to cover the discharge valve 131. This first muffler cover 140 is fixed to the body portion 51 by a fixing member (bolt or the like). The first muffler cover 140 is passed through by the boss portion 52.

The first muffler cover 140 and the upper-side end plate member 50 define a first muffler chamber 142. The first muffler chamber 142 and the first cylinder chamber 122 are communicated with each other via the discharge opening 51*a*.

The lower-side end plate member 60 has a disc-shaped body portion 61, and a boss portion 62 provided in a center of the body portion 61 so as to extend downward. The body portion 61 and the boss portion 62 are passed through by the shaft 12. The body portion 61 is provided with a discharge opening (not shown) communicating with the second cylinder chamber 222.

A discharge valve (not shown) is attached to the body portion 61 so as to be positioned on one side of the body portion 61 opposite to the side to which the second cylinder 221 is attached. This discharge valve opens and closes the discharge opening.

On the body portion 61, to its one side opposite to the side to which the second cylinder 221 is attached, a linear- and plate-shaped second muffler cover 240 is provided so as to cover the discharge valve. This second muffler cover 240 is fixed to the body portion 61 by a fixing member (bolt or the like). The second muffler cover 240 is passed through by the boss portion 62.

The second muffler cover 240 and the lower-side end plate member 60 define a second muffler chamber 242. The second muffler chamber 242 and the second cylinder chamber 222 are communicated with each other via the discharge opening.

On the first muffler cover 140, to its one side opposite to the side on which the upper-side end plate member 50 is attached, a cup-shaped third muffler cover 340 is provided so as to cover the first muffler cover. The first muffler cover 140 and the third muffler cover 340 define a third muffler chamber 342.

The first muffler chamber 142 and the third muffler chamber 342 are communicated with each other through a hole portion (not shown) formed in the first muffler cover 140.

The second muffler chamber 242 and the third muffler chamber 342 are communicated with each other through hole portions (not shown) formed in the lower-side end plate member 60, the second cylinder 221, the intermediate end plate member 70, the first cylinder 121 and the upper-side end plate member 50.

The third muffler chamber 342 and an exterior of the third muffler cover 340 are communicated with each other through a hole portion (not shown) formed in the third muffler cover 340.

The end plate members 50, 60, 70, the cylinders 121, 221, and the muffler covers 140, 240, 340 are integrally fixed together by fixing members such as bolts. The upper-side end plate member 50 of the compression element 2 is attached to the closed container 1 by welding or the like.

One end portion of the shaft 12 is supported by the upper-side end plate member 50 and the lower-side end plate member 60. That is, the shaft 12 is cantilevered. One end portion (a supported end side) of the shaft 12 reaches interiors of the first cylinder chamber 122 and the second cylinder chamber 222.

In the shaft 12, a first eccentric pin 126 is provided so as to be positioned within the first cylinder chamber 122. The first eccentric pin 126 is fitted to a first roller 127. The first roller 127 is placed in the first cylinder chamber 122 so as to be revolvable around a center axis of the first cylinder chamber 122, so that the revolving motion of the first roller 127 fulfills the compression action.

In the shaft 12, a second eccentric pin 226 is provided so as to be positioned within the second cylinder chamber 222. The second eccentric pin 226 is fitted to a second roller 227. The second roller 227 is placed in the second cylinder chamber 222 so as to be revolvable around a center axis of the second cylinder chamber 222, so that the revolving motion of the second roller 227 fulfills the compression action.

The first eccentric pin 126 and the second eccentric pin 226 are so positioned as to be shifted by 180° from the rotational axis of the shaft 12.

Next, the compression action of the first cylinder chamber 122 is explained.

Figure 2:
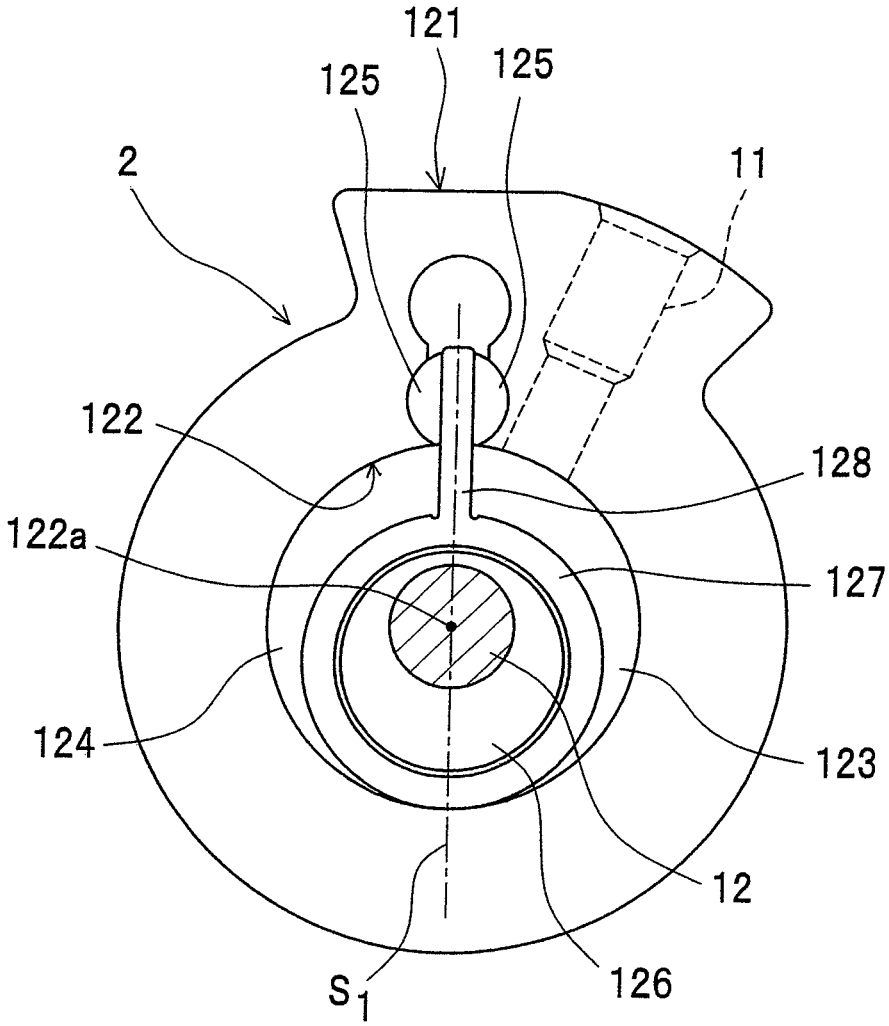
FIG. 2 is a plan view of main part of the rotary compressor.

As shown in FIG. 2, the interior of the first cylinder chamber 122 is partitioned by a blade 128 provided integrally with the first roller 127. That is, in a chamber on the right side of the blade 128, an inlet pipe 11 is opened in the inner surface of the first cylinder chamber 122 to form an inlet chamber (low-pressure chamber) 123 for refrigerant gas. On the other hand, in a chamber on the left side of the blade 128, the discharge opening 51*a* (shown in FIG. 1) is opened in the inner surface of the first cylinder chamber 122 to form a discharge chamber (high-pressure chamber) 124 for refrigerant gas.

Semicolumnar-shaped bushings 125, 125 are set in close contact with both sides of the blade 128 to make up a seal. The bushings 125, 125 are held on the first cylinder 121. That is, the blade 128 is supported by the first cylinder 121. Lubrication with the lubricating oil 9 is provided between the blade 128 and the bushings 125, 125, and between the bushings 125 and the first cylinder 121.

Then, as the first eccentric pin 126 eccentrically rotates along with the shaft 12, the first roller 127 fitted to the first eccentric pin 126 revolves with the outer circumferential surface of the first roller 127 kept in contact with the inner circumferential surface of the first cylinder chamber 122.

As the first roller 127 revolves within the first cylinder chamber 122, the blade 128 advances and retreats while both side faces of the blade 128 are held by the bushings 125, 125. Then, the low-pressure refrigerant gas is sucked into the inlet chamber 123 from the inlet pipe 11, and compressed in the discharge chamber 124 into high pressure, after which a high-pressure refrigerant gas is discharged from the discharge opening 51*a* (shown in FIG. 1).

Thereafter, as shown in FIG. 1, the refrigerant gas discharged from the discharge opening 51*a* is discharged via the first muffler chamber 142 and the third muffler chamber 342 to outside of the third muffler cover 340.

On the other hand, the compression action of the second cylinder chamber 222 is also similar to the compression action of the first cylinder chamber 122. That is, the low-pressure refrigerant gas is sucked into the second cylinder chamber 222 from the other inlet pipe 11, and the refrigerant gas is compressed in the second cylinder chamber 222 by the revolving motion of the second roller 227. The resulting high-pressure refrigerant gas is discharged via the second muffler chamber 242 and the third muffler chamber 342 to outside of the third muffler cover 340.

The compression action by the first cylinder chamber 122 and the compression action by the second cylinder chamber 222 are shifted 180° in phase from each other.

Figure 3:
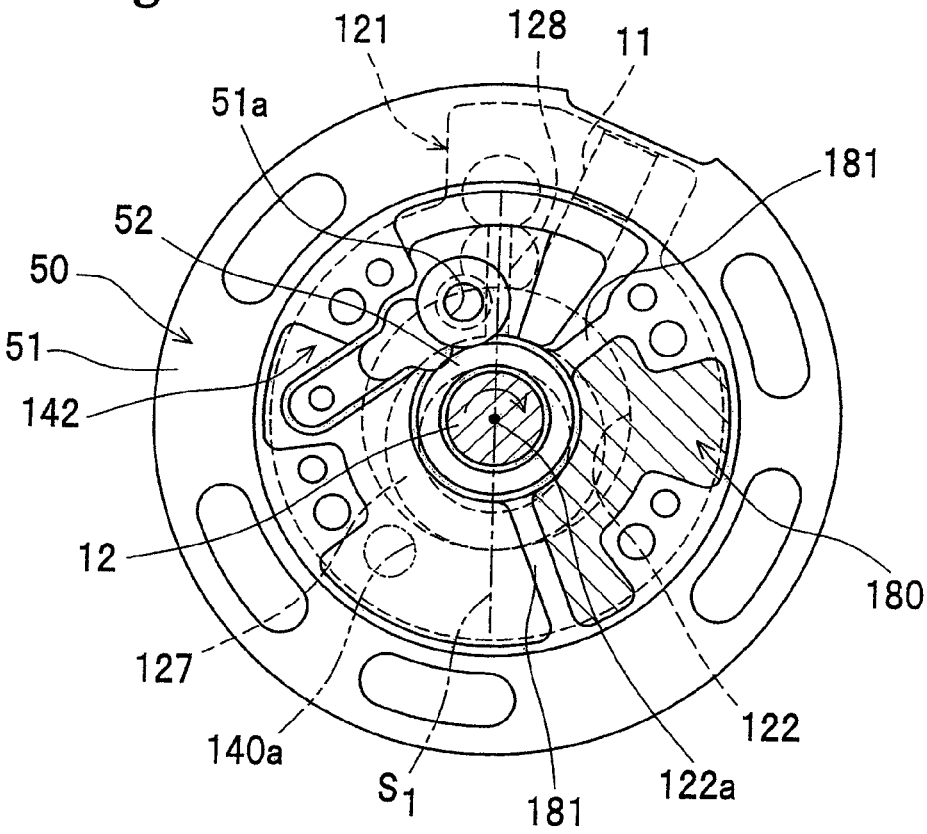
FIG. 3 is a cross-sectional view of a vicinity of a first muffler chamber of the rotary compressor.

As shown in FIG. 3, the first muffler chamber 142 is provided with a stagnation space 180 into which the refrigerant gas does not enter. In FIG. 3, the stagnation space 180 is hatched for an easier understanding. Also, the first muffler cover 140 is omitted in illustration.

The stagnation space 180, as shown in FIGS. 2 and 3, overlaps with a refrigerant-gas inlet side (the side on which the inlet pipe 11 is provided) of the first cylinder chamber 122, the inlet side being bordered by a center plane $S_1$ which passes through a center of the blade 128 most projecting into the first cylinder chamber 122 and through a center axis 122*a* of the first cylinder chamber 122, as viewed in the direction of the center axis 122*a* of the first cylinder chamber 122.

The stagnation space 180 is formed between two barriers 181, 181. The barriers 181 are formed integrally with the upper-side end plate member 50 to couple the body portion 51 and the boss portion 52 to each other. The barriers 181 extend radially outward from the boss portion 52. That is, the barriers 181 function as ribs to improve the strength of the upper-side end plate member 50.

The barriers 181 and the first muffler cover 140 (shown in FIG. 1) may be either in contact with each other or spaced from each other with a slight gap therebetween. That is, the stagnation space 180 may be a closed or opened space.

In the first muffler chamber 142 of this construction, a high-temperature, high-pressure refrigerant gas discharged from the first cylinder chamber 122 through the discharge opening 51*a* into the first muffler chamber 142 is obstructed by the barriers 181, thus being unlikely to enter into the stagnation space 180.

That is, the high-temperature, high-pressure refrigerant gas is unlikely to pass through the space overlapping with the low-temperature, low-pressure inlet side of the first cylinder chamber 122, so that heat of the refrigerant gas is less absorbed to the inlet side of the first cylinder chamber 122.

Accordingly, as to the refrigerant gas discharged from the first cylinder chamber 122 to the first muffler chamber 142, heat transfer to the first cylinder chamber 122 is suppressed, so that the compression efficiency can be improved.

In addition, the refrigerant gas of the first muffler chamber 142, passing through the hole portion 140*a* formed in the first muffler cover 140 (shown in FIG. 1), is discharged into the third muffler chamber 342 (shown in FIG. 1).

Figure 4:
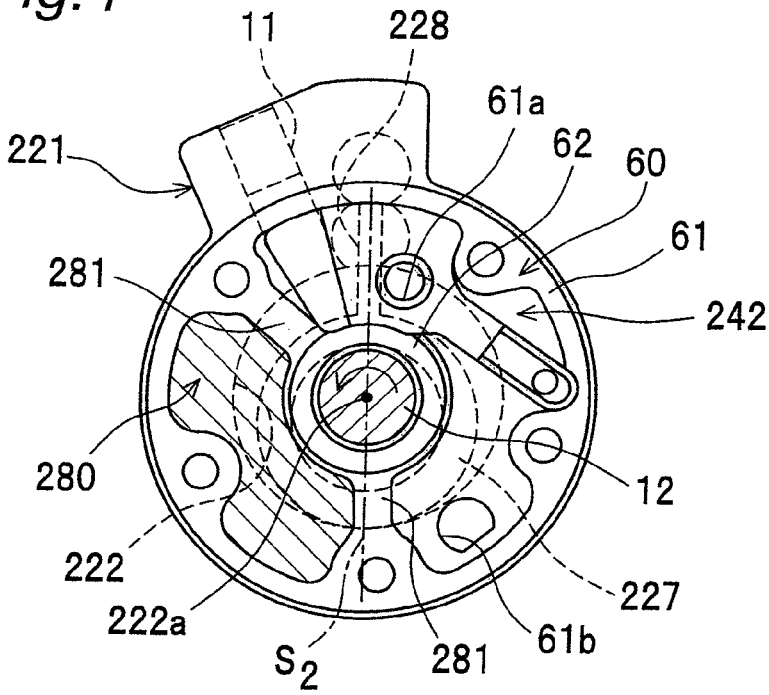
FIG. 4 is a cross-sectional view of a vicinity of a second muffler chamber of the rotary compressor.

As shown in FIG. 4, the second muffler chamber 242 is provided with a stagnation space 280 into which the refrigerant gas does not enter. In FIG. 4, the stagnation space 280 is hatched for an easier understanding. Also, the second muffler cover 240 is omitted in illustration.

The stagnation space 280 overlaps with a refrigerant-gas inlet side (the side on which the inlet pipe 11 is provided) of the second cylinder chamber 222, the inlet side being bordered by a center plane $S_2$ which passes through a center of the blade 228 most projecting into the second cylinder chamber 222 and through a center axis 222*a* of the second cylinder chamber 222, as viewed in the direction of the center axis 222*a* of the second cylinder chamber 222.

The stagnation space 280 is formed between two barriers 281, 281. The barriers 281 are formed integrally with the lower-side end plate member 60 to couple the body portion 61 and the boss portion 62 to each other. The barriers 281 extend radially outward from the boss portion 62. That is, the barriers 281 function as ribs to improve the strength of the lower-side end plate member 60.

Also, since the barriers 281 are formed integrally with the lower-side end plate member 60, the second muffler cover 240 (shown in FIG. 1) can be formed into a flat plate shape, so that the second muffler cover 240 can be formed simply.

The barriers 281 and the second muffler cover 240 (shown in FIG. 1) may be either in contact with each other or spaced from each other with a slight gap therebetween. That is, the stagnation space 280 may be a closed or opened space.

In the second muffler chamber 242 of this construction, a high-temperature, high-pressure refrigerant gas discharged from the second cylinder chamber 222 through the discharge opening 61*a* into the second muffler chamber 242 is obstructed by the barriers 281, thus being unlikely to enter into the stagnation space 280.

That is, the high-temperature, high-pressure refrigerant gas is unlikely to pass through the space overlapping with the low-temperature, low-pressure inlet side of the second cylinder chamber 222, so that heat of the refrigerant gas is less absorbed to the inlet side of the second cylinder chamber 222.

Accordingly, as to the refrigerant gas discharged from the second cylinder chamber 222 to the second muffler chamber 242, heat transfer to the second cylinder chamber 222 is suppressed, so that the compression efficiency can be improved.

In addition, the refrigerant gas in the second muffler chamber 242, passing through a hole portion 60*b* formed in the lower-side end plate member 60, is discharged into the third muffler chamber 342 (shown in FIG. 1).

In the rotary compressor of this construction, as shown in FIG. 1, since the third muffler chamber 342 is formed so as to be communicated with the first muffler chamber 142 and the second muffler chamber 242, a muffler space can be ensured by the third muffler chamber 342. That is, by providing a two-stage muffler as shown above, the first muffler chamber 142 and the second muffler chamber 242 can be made smaller in muffler space, so that the refrigerant gas can be prevented from acceleration of heat transfer.

The present invention is not limited to the above-described embodiment. For example, the invention may be applied to rotary type compressors in which a roller and a blade are provided independently of each other as the compression element 2. The compression element 2 may be of a 1-cylinder type having one cylinder chamber. Also, a one-stage muffler with the third muffler cover 340 omitted may also be adopted.

Furthermore, the barriers 181, 281 may be provided on the side on which the muffler covers 140, 240 are provided. Also, the barriers 181, 281 may be provided for the end plate members 50, 60 and the muffler covers 140, 240.

The invention claimed is:

1. A rotary compressor comprising:

a cylinder having an opening end;

an end plate member attached to the opening end of the cylinder on a first side of the end plate member;

a muffler cover attached to a second side of the end plate member opposite to the first side of the end plate member to which the cylinder is attached; and a roller and a blade arranged to partition a cylinder chamber into a refrigerant-gas inlet chamber and a refrigerant-gas discharge chamber, the cylinder chamber being defined by the cylinder and the end plate member, the blade being supported by the cylinder, and the roller being arranged to revolve around a center axis of the cylinder chamber, the muffler cover and the end plate member being arranged to form a muffler chamber which communicates with the refrigerant-gas discharge chamber of the cylinder chamber through an opening formed in the end plate member and which is located in a region of an entire circumference around the center axis of the cylinder chamber, the muffler chamber having only two barriers which extend in a radial direction from a central hub of the muffler chamber, and being circumferentially partitioned into a first space and a second space separate from the first space with respect to circumferential direction by the two barriers, the opening being formed in a region of the end plate member corresponding to the first space, a hole portion being formed in a region of the muffler cover corresponding to the first space, the hole portion being configured to discharge refrigerant-gas from the muffler chamber, such that the first space allows the refrigerant-gas to flow from the opening to the hole portion, while the second space forms a stagnation chamber which has a higher resistance to flowthrough of refrigerant gas than the first space, and the stagnation chamber overlapping a refrigerant-gas inlet side of the cylinder chamber as viewed along the center axis of the cylinder chamber, the refrigerant-gas inlet side being formed on one side of a center plane passing through the blade and passing through the center axis of the cylinder chamber.

2. The rotary compressor as claimed in claim 1, wherein the barriers are formed integrally with the end plate member, and the muffler cover is formed into a flat plate shape.

3. The rotary compressor as claimed in claim 1, wherein the muffler cover has a first cover side and a second cover side, where the second cover side is opposite to the first cover side and attached to the end plate member, and the rotary compressor further comprises another muffler cover attached to the first cover side of the muffler cover, the another muffler cover and the muffler cover defining another muffler chamber in fluid communication with the muffler chamber.

4. The rotary compressor as claimed in claim 1, wherein, the end plate member has a body portion and a boss portion provided on an inner periphery of the body portion, and the barriers are formed integrally with the end plate member so as to couple the body portion and the boss portion to each other.

5. The rotary compressor as claimed in claim 1, wherein an angle between the barriers is an obtuse angle.

6. The rotary compressor as claimed in claim 1, wherein each barrier has a pair of surfaces which are oppositely facing and radially extending.

7. The rotary compressor as claimed in claim 1, wherein the barriers extend radially outwardly from an inner annular periphery of the muffler chamber.

8. The rotary compressor as claimed in claim 1, wherein the stagnation chamber is an open space in partial fluid communication with the first space.

* * * * *